US006990902B2

(12) United States Patent
Kelm et al.

(10) Patent No.: US 6,990,902 B2
(45) Date of Patent: Jan. 31, 2006

(54) DISPLACEMENT DEVICE FOR A MACHINE FOR PROCESSING FLAT PRINTING MATERIALS AND MACHINE HAVING THE DISPLACEMENT DEVICE

(75) Inventors: Carsten Kelm, Ketsch (DE); Udo Lautenklos, Wald-Michelbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 21 days.

(21) Appl. No.: 10/278,231

(22) Filed: Oct. 23, 2002

(65) Prior Publication Data

US 2003/0075061 A1 Apr. 24, 2003

(30) Foreign Application Priority Data

Oct. 23, 2001 (DE) ..... 101 52 277

(51) Int. Cl.
*B41F 13/24* (2006.01)

(52) U.S. Cl. ..... 101/228; 101/232; 101/234; 400/646; 400/647; 400/647.1; 400/693; 271/207; 271/213; 271/292

(58) Field of Classification Search ..... 400/646, 400/647, 647.1, 691, 693; 101/228, 232, 101/216, 233, 234; 271/204, 207, 197, 183, 271/277, 213, 214, 292, 293, 294, 290, 300
See application file for complete search history.

(56) References Cited

U.S. PATENT DOCUMENTS 5,649,483 A * 7/1997 Mack et al. ..... 101/232
5,746,528 A * 5/1998 Mayer et al. ..... 400/625
6,474,884 B2 * 11/2002 Chiu ..... 400/624
6,505,828 B2 * 1/2003 Seitz et al. ..... 271/204
6,543,764 B1 * 4/2003 Mallok ..... 271/183
6,623,003 B1 * 9/2003 Koizumi et al. ..... 271/270
2002/0014738 A1 2/2002 Seitz et al.
2002/0109286 A1 8/2002 Mutschall et al.

FOREIGN PATENT DOCUMENTS

| | | |
|---|---|---|
| DE | 41 38 280 A1 | 5/1993 |
| DE | G 93 05 757.1 U1 | 9/1993 |
| DE | 195 19 374 C2 | 11/1996 |
| DE | 100 49 181 A1 | 5/2001 |
| DE | 101 10 441 A1 | 10/2001 |
| DE | 101 29 895 A1 | 3/2002 |
| DE | 101 05 374 A1 | 8/2002 |

* cited by examiner

*Primary Examiner*—Andrew H. Hirshfeld
*Assistant Examiner*—Kevin D. Williams
(74) *Attorney, Agent, or Firm*—Laurence A. Greenberg; Werner H. Stemer; Ralph E. Locher

(57) ABSTRACT

A displacement device for a machine for processing flat printing materials includes a slide displaceable along a displacement path in and counter to a thrust direction, and being divided along the thrust direction into two slide parts. A drag joint forms a mutual connection between the slide parts. The drag joint has a joint axis extending perpendicularly to the displacement path. A machine for processing flat printing materials, such as a sheet-processing rotary printing press, is provided with the displacement device.

8 Claims, 7 Drawing Sheets

DISPLACEMENT DEVICE FOR A MACHINE FOR PROCESSING FLAT PRINTING MATERIALS AND MACHINE HAVING THE DISPLACEMENT DEVICE

BACKGROUND OF THE INVENTION

Field of the Invention

The invention relates to a displacement device for a machine for processing flat printing materials, in particular a sheet-processing rotary printing press. The invention also relates to a machine for processing flat printing materials, in particular a sheet-processing rotary printing press, which is equipped with the displacement device.

A displacement device for a machine for processing flat printing materials is disclosed by German Patent DE 195 19 374 C2, corresponding to U.S. Pat. No. 5,649,483, and is provided to accommodate sheets singled out or discharged over a delivery pile or stack in a sheet-processing rotary printing press, the sheets being in particular in the form of proof sheets. A displacement device provided for such use must of course also be able to accommodate sheets with the largest format that can be processed by the rotary printing press and, for this purpose, have at least a width which corresponds to the extent of the format transverse to the passage direction of sheets through the rotary printing press. However, in conventional rotary printing presses, this extent is greater than the extent of the sheets in the travel direction thereof.

A displacement device adjusted to or matching the format of the sheet already has a tendency to canting, due to the fact that it has a greater extent transverse to the travel direction in comparison with the extent thereof in the travel direction, so that the handling of the displacement device requires particular attention by a user with regard to canting. This is because actuating forces for displacing the displacement device have to be applied centrally symmetrically with respect to the width thereof if canting is to be avoided. The aforementioned tendency towards canting additionally occurs to an intensified extent if guides are provided which have a guide length, for example necessitated by structural conditions, which is shorter than the extent of the displacement device in the thrust direction.

SUMMARY OF THE INVENTION

It is accordingly an object of the invention to provide a displacement device for a machine for processing flat printing materials, in particular a sheet-processing rotary printing press, and a machine having the displacement device, which overcome the hereinafore-mentioned disadvantages of the heretofore-known devices of this general type and which are user-friendly.

With the foregoing and other objects in view, there is provided, in accordance with the invention, a displacement device for a machine for processing flat printing materials, comprising a slide displaceable along a displacement path in and counter to a thrust direction, and being divided: along the thrust direction into two slide parts. A drag joint forms a mutual connection between the slide parts. The drag joint has a joint axis extending perpendicularly to the displacement path.

In accordance with another feature of the invention, the slide includes a pair of skids. The drag joint is disposed at least approximately centrally between the skids.

In accordance with a further feature of the invention, the slide includes a pair of skids and a pair of drag arms. A respective one of the drag arms is fixed to a respective one of the skids and is directed towards the respective other of the skids. The drag joint serves for connecting the one drag arm to the other drag arm.

In accordance with an added feature of the invention, a respective one of the slide parts has a support whereon the respective other of the slide parts is supported.

In accordance with an additional feature of the invention, the displacement device further includes a transverse connector. A rotary joint connects the transverse connector to a first one of the slide parts. The rotary joint has a joint axis extending perpendicularly to the displacement path. A sliding joint connects the transverse connector to a second one of the slide parts and has a winged pin which is held on the transverse connector and is disposed parallel to the joint axis. A sliding joint part is connected to the second slide part and is formed as a support for the transverse connector. The sliding joint part is formed with a slotted guide for accommodating the winged pin therein. The slotted guide extends transversely to the thrust direction.

In accordance with yet another feature of the invention, the displacement device further includes a support for the drag arm of the second slide part. The support is formed on the drag arm of the first slide part at a side of the skid of the first slide part.

In accordance with yet a further feature of the invention, the rotary joint is disposed at one end of one of the skids. The sliding joint is disposed at a corresponding end of the other of the skids. The transverse connector is formed as a handle bar.

With the objects of the invention in view, there is also provided a machine for processing flat printing materials, comprising a displacement device. The displacement device includes a slide displaceable along a displacement path in and counter to a thrust direction, and being divided along the thrust direction into two slide parts. A drag joint forms a mutual connection between the slide parts. The drag joint has a joint axis extending perpendicularly to the displacement path.

In accordance with a concomitant feature of the invention, the machine for processing flat printing materials is a sheet-processing rotary printing press.

Thus, according to the invention, the foregoing object thereof is achieved by the slide which is displaceable along a displacement path in and counter to a thrust direction and is divided along the thrust direction into two slide parts, as well as a drag joint forming a mutual connection between the slide parts. The drag joint has a joint axis which is perpendicular to the displacement path.

If, in a preferred refinement, a respective one of the slide parts is equipped with a guided skid, and the drag joint is disposed centrally between the slide parts. Then, in the event of an off-center introduction of an actuating force for displacing the slide, a force acts upon one of the slide parts with a lever arm which corresponds at most to half the distance between the skids. A force acts upon the other of the slide parts with a lever arm which is smaller than half the aforementioned distance. A result, therefore, when compared with an undivided slide, considerably lower tilting moments act upon the skids.

Other features which are considered as characteristic for the invention are set forth in the appended claims.

Although the invention is illustrated and described herein as embodied in a displacement device for a machine for processing flat printing materials and a machine having the displacement device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

A sheet-processing rotary printing press having a delivery constructed for removing, i.e., singling out or discharging paper waste and proof sheets, preferably has, for orderly deposition of the discharged or singled-out sheets, a deposition device constructed for accommodating the sheets, which adjoins the delivery and is preferably constructed so that, if necessary, it can be displaced downstream with respect to the discharge direction and out of the delivery.

Deliveries constructed for the aforementioned discharging or singling-out action are described in German Patent DE 195 19 374 C2, corresponding to U.S. Pat. No. 5,649,483, and in German Published, Non-prosecuted Patent Application DE 101 05 374 A1, corresponding to U.S. Patent Application Publication No. 2002/0109286 A1, German Published, Non-prosecuted Patent Application DE 101 10 441 A1 and German Published, Non-prosecuted Patent Application DE 101 29 895 A1, corresponding to U.S. Patent Application Publication No. 2002/0014738 A1, to the teachings of which relative to the configuration of a delivery, reference is accordingly made herein.

Figure 1:
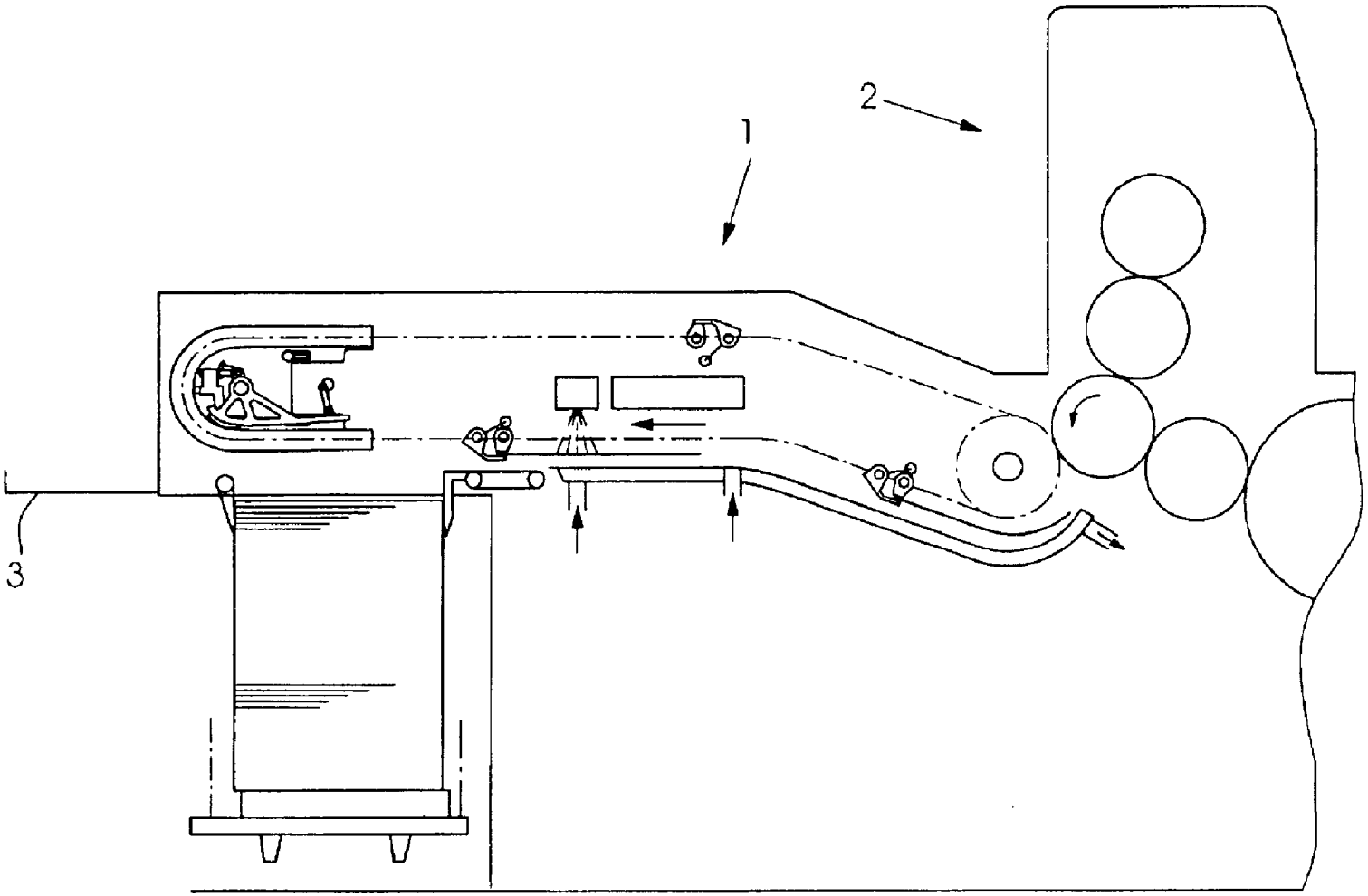
FIG. 1 is a fragmentary, diagrammatic, side-elevational view of a machine for processing flat printing materials, showing the delivery thereof having a displacement device according to the invention disposed thereon.

Referring now to the figures of the drawings in detail and first, particularly, to FIG. 1 thereof, there is illustrated therein, by way of example, a section of a sheet-processing rotary printing press having a last processing station 1 and a delivery 2 following the latter in a processing direction. This section of the sheet-processing rotary printing press is constructed to a very great extent in a manner analogous to the corresponding section described in the hereinaforementioned German Published, Non-prosecuted Patent Application DE 101 05 374 A1, corresponding to U.S. Patent Application Publication No. 2002/0109286 A1. However, in order to deposit discharged or singled-out sheets, it includes a slide 3 which, in FIG. 1, is diagrammatically illustrated in a condition wherein it is slid out of the delivery 2 along a displacement path in a thrust direction corresponding to the discharge direction.

Figure 2:
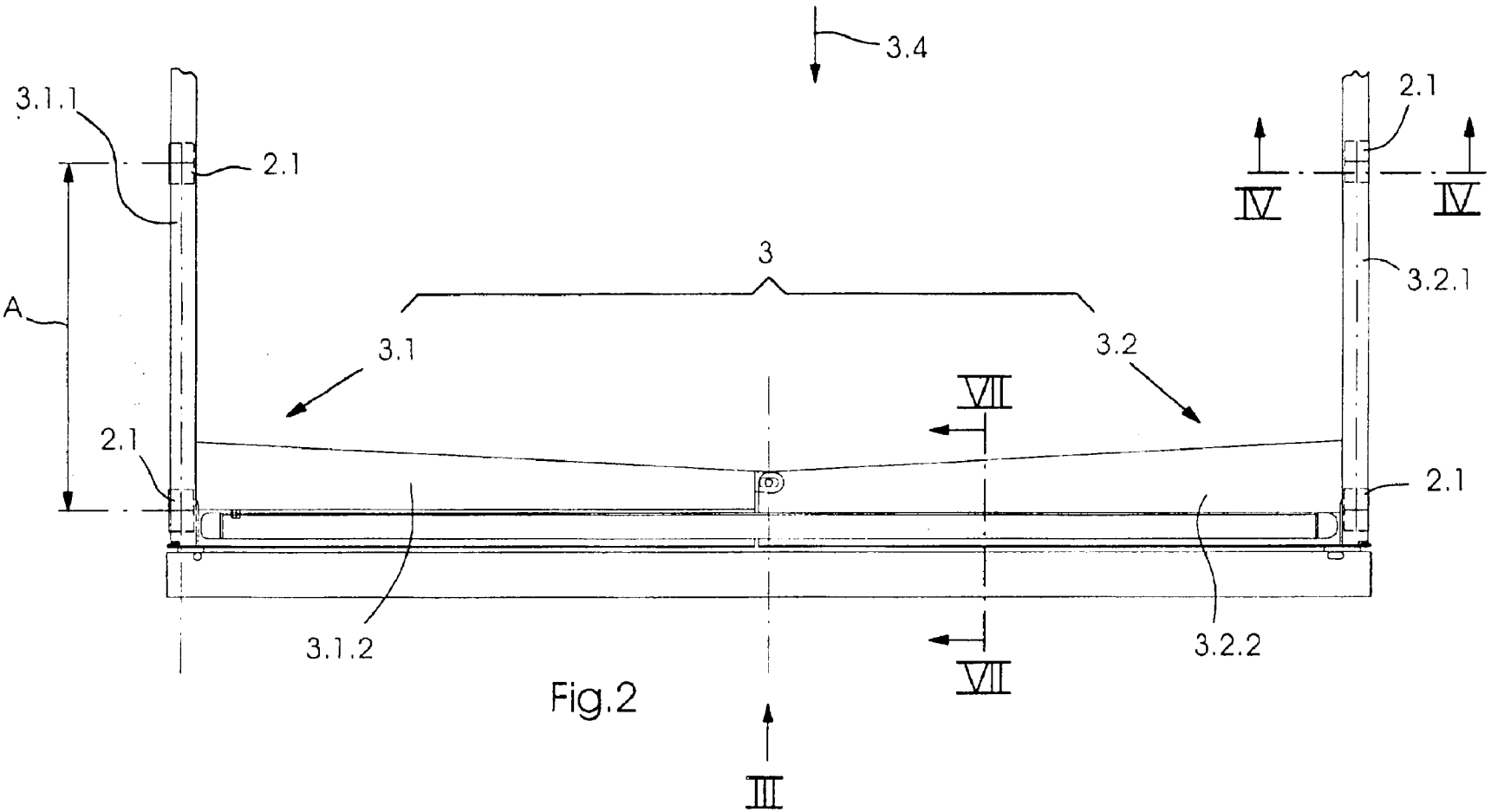
FIG. 2 is an enlarged, top-plan view of FIG. 1, rotated 90° counterclockwise, showing an exemplary embodiment of the displacement device, removed from the delivery.

A plan view of the slide 3, reproduced in FIG. 2, shows a subdivision thereof into slide parts 3.1 and 3.2 along the thrust direction. The slide parts 3.1 and 3.2 are mutually connected via a drag joint or link 3.3 having a drag link axis 3.3.1 which can be seen in FIG. 3 and is perpendicular to the aforementioned displacement path. Each of the slide parts 3.1 and 3.2 includes a respective skid 3.1.1 and 3.2.1, which is oriented in the discharge direction represented by the arrow 3.4. An area covered by the skids 3.1.1 and 3.2.1 forms the displacement path which, in the case at hand, of rigid and rectilinear skids, results in an area lying in the plane of the drawing of FIG. 2 or parallel thereto.

As is further recognizable from FIG. 2, the slide parts 3.1 and 3.2 include respective drag arms 3.1.2 and 3.2.2, each of which is fixed to the appertaining skids 3.1.1 and 3.2.1, respectively, and is directed towards the respective other one of the skids 3.1.1 and 3.2.1. The drag arms 3.1.2 and 3.2.2 are connected to one another by the aforementioned drag link or joint 3.3 which is preferably disposed at least approximately centrally between the skids 3.1.1 and 3.2.1.

Figure 3:
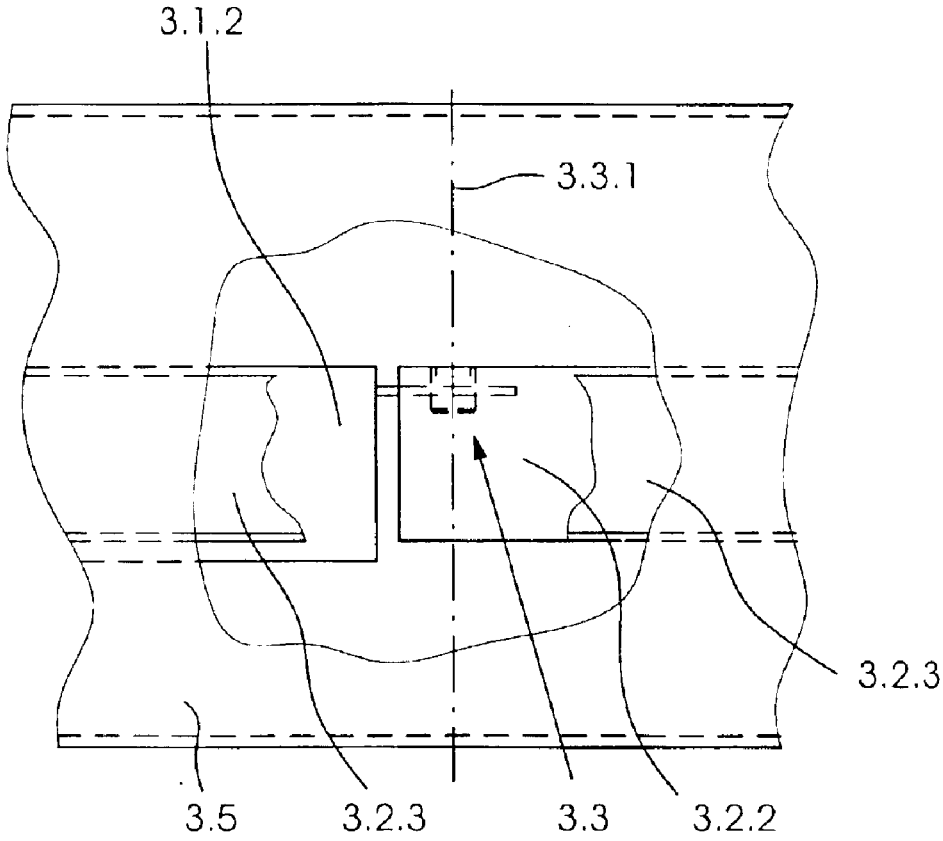
FIG. 3 is an enlarged, fragmentary and partly broken-away front-elevational view of FIG. 2, taken in the direction of an arrow III therein.
Figure 5:
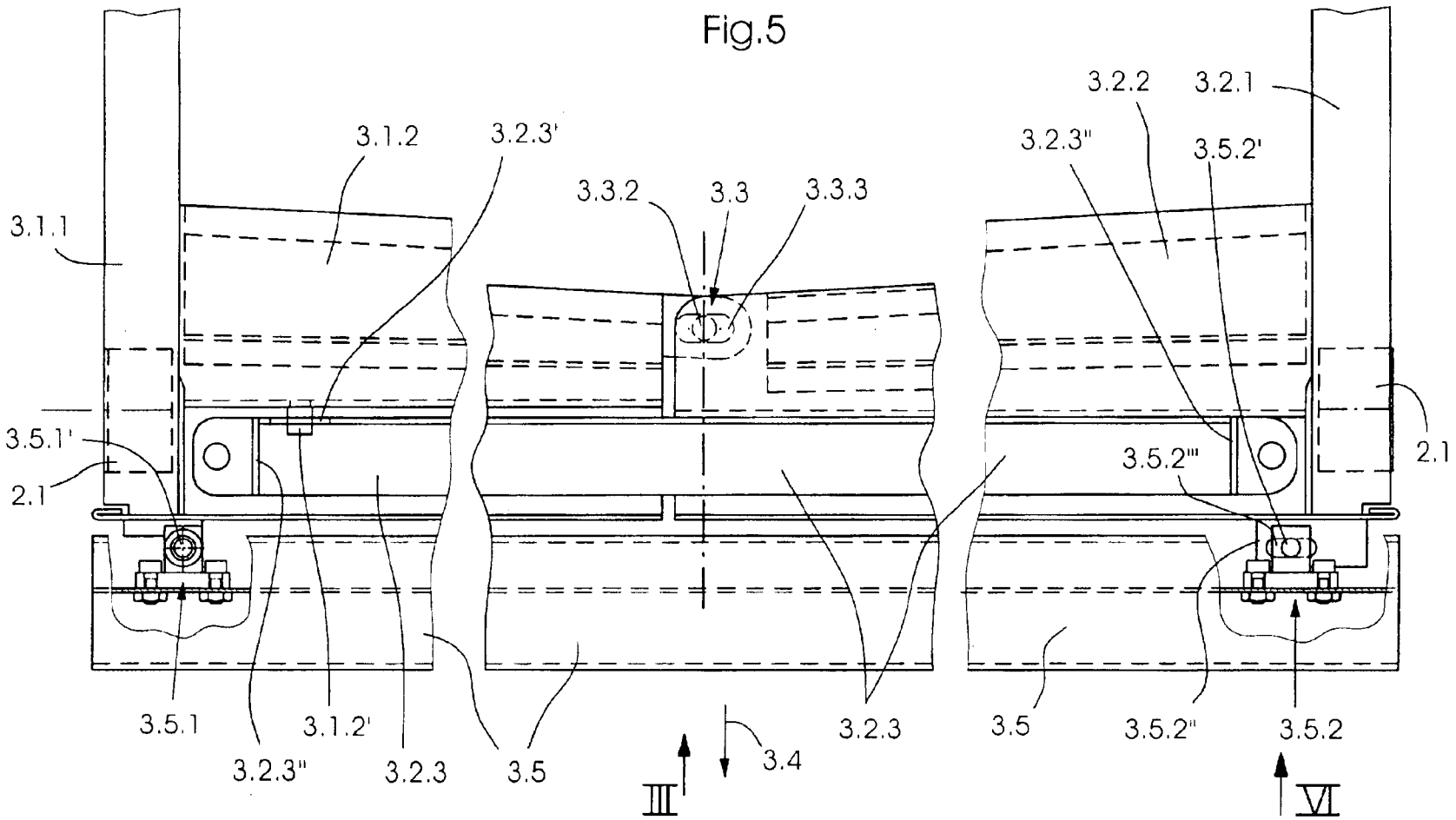
FIG. 5 is an enlarged, fragmentary, partly broken-away view of FIG. 2, showing further details of the displacement device.

As is believed to be apparent from FIG. 3 in conjunction with FIG. 5, the drag joint or link 3.3 includes a drag joint pin 3.3.2 which, in the configuration at hand, is fixed to the drag arm 3.2.2, and engages in a recess 3.3.3 formed in the drag arm 3.2.1. In this regard, the recess 3.3.3 is preferably formed as an elongated hole or slot, which extends transversely with respect to the thrust direction of the slide 3, and accommodates the drag joint pin 3.3.2 slidingly therein.

Figure 4:
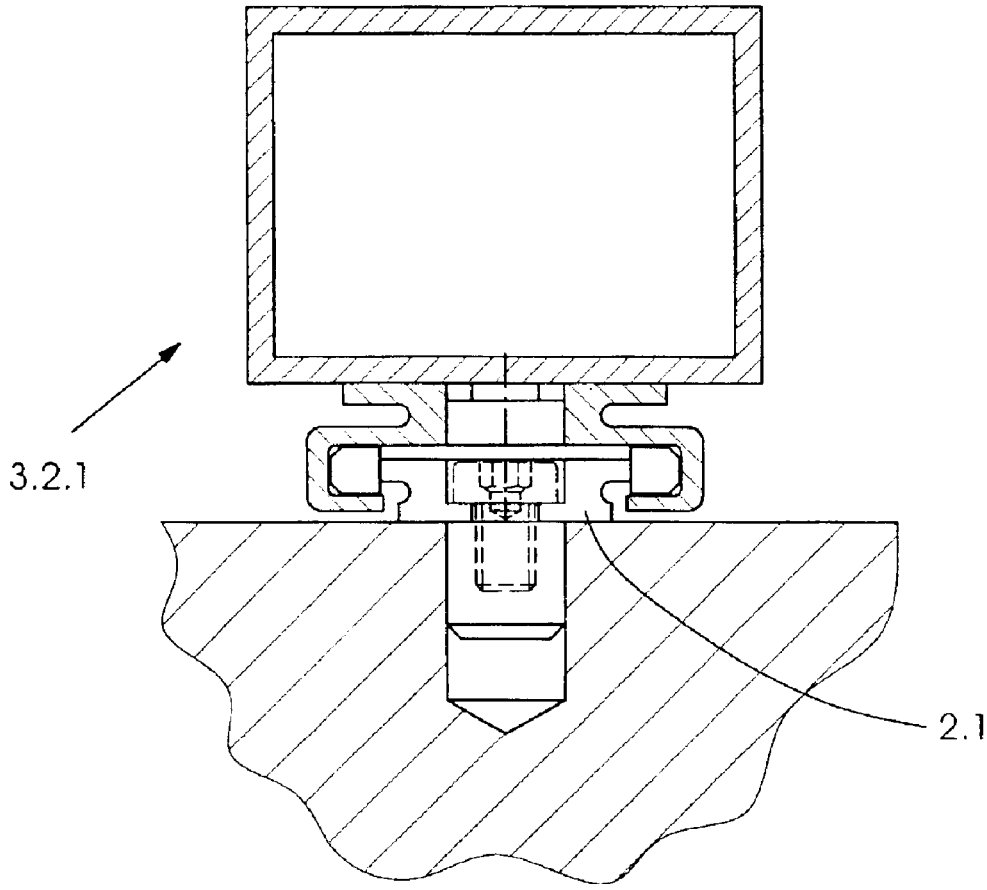
FIG. 4 is an enlarged, fragmentary, sectional view of FIG. 2, taken along the line IV—IV therein in the direction of the arrows.

According to the sectional view of one of the skids reproduced in FIG. 4, here the skid 3.2.1, they have a respective guide profile on the underside thereof. Two grooved or notched blocks 2.1 engage in a respective guide profile, are disposed at a mutual spacing A (note FIG. 2) in the longitudinal direction of the skids 3.1.1 and 3.2.1, and are in particular pinned and screwed to the delivery 2.

In an advantageous construction, a respective one of the slide parts 3.1 and 3.2 has a support whereon the respective other one thereof is supported.

According to FIG. 5, this is realized or implemented as follows in the illustrated exemplary embodiment.

On the side of the skid 3.1.1 of a first of the two slide parts, here the slide part 3.1, a pin 3.1.2' oriented in the discharge direction represented by the arrow 3.4 is fixed to the drag arm 3.1.2 thereof. Fixed to the drag arm 3.2.2 of the second slide part 3.2 is a profiled strip 3.2.3, which extends as far as the immediate vicinity of the skid 3.1.1 of the first slide part 3.1 and is formed with a slot or elongated hole 3.2.3' thereat into which the aforementioned pin 3.1.2' is engageable and so as to extend transversely thereto in a direction which is oriented parallel to the aforementioned displacement path. In this respect, the pin 3.1.2' on the first slide part 3.1 forms a support for the second slide part 3.2.

As is believed to be apparent from FIG. 5, in the exemplary embodiment shown therein, in order to realize or implement the mutual support of one of the slide parts 3.1 and 3.2 of the respective other one, a transverse connector 3.5 is also provided. The latter is connected to the first slide part 3.1 by a rotary joint 3.5.1, the rotary joint 3.5.1 having only one degree of freedom relating to rotation about a joint axis 3.5.1' perpendicularly to the aforementioned displacement path.

Furthermore, the transverse connector 3.5 is connected to the second slide part 3.2 via a sliding joint 3.5.2, the sliding joint 3.5.2 having a winged or link pin 3.5.2' which is held on the transverse connector 3.5 and is disposed parallel to the joint axis 3.5.1' of the rotary joint 3.5.1 that connects the transverse connector 3.5 to the first slide part 3.1. Fixed to the second slide part 3.2 is a sliding joint part 3.5.2" having a slotted guide 3.5.2'" wherein the winged or link pin 3.5.2' engages and extends transversely with respect to the aforementioned thrust direction.

Figure 6:
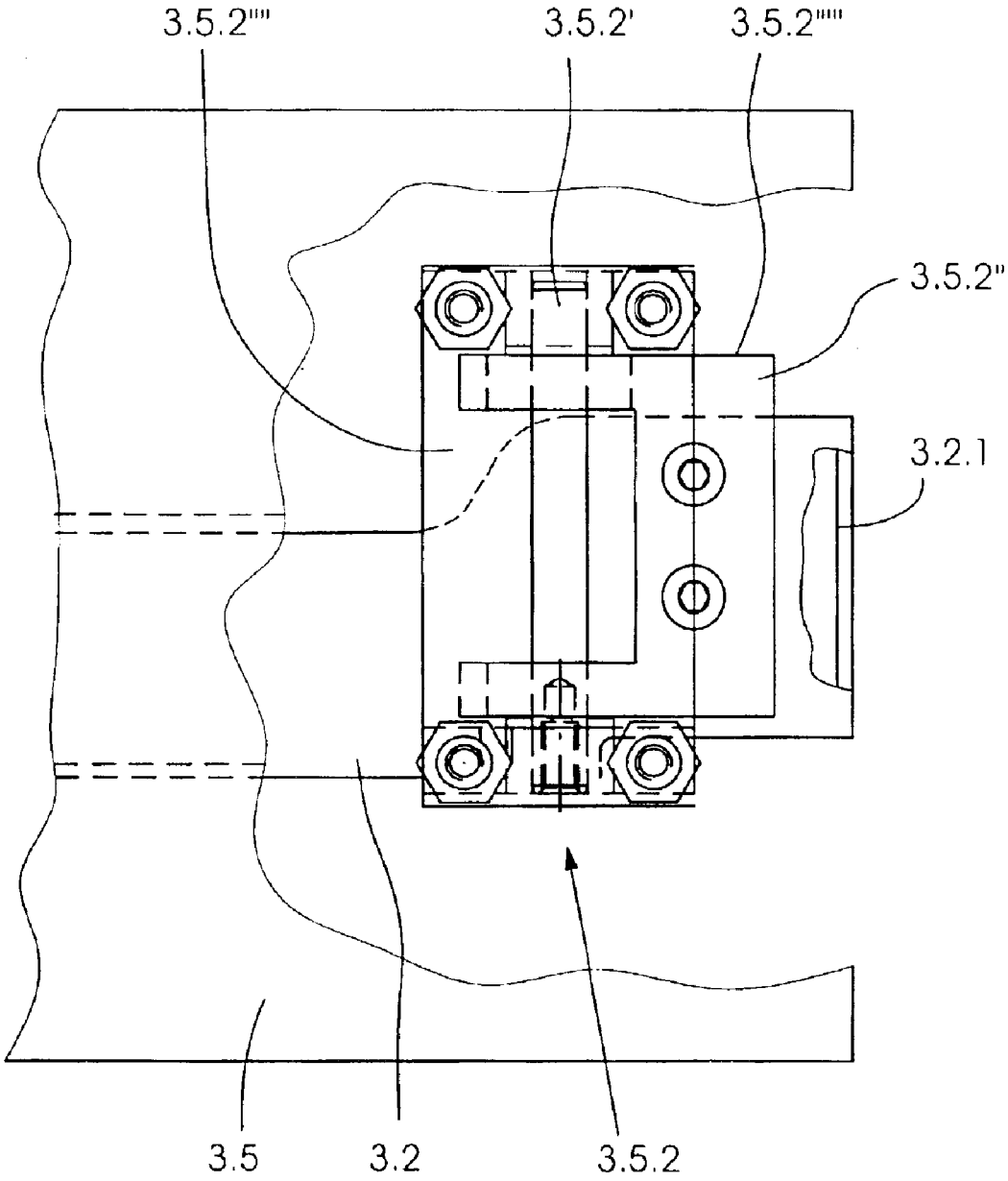
FIG. 6 is an enlarged, fragmentary, front-elevational view of FIG. 5 taken in the direction of an arrow VI therein.

Further details of the connection of the transverse connector 3.5 to the second slide part 3.2 may be seen in FIG. 6, as follows:

The winged or link pin 3.5.2' is fixed in a holder 3.5.2"" which, in the example at hand, is fixed to the transverse connector 3.5 by screw connections. The holder 3.5.2"" is formed as a plate which, at upper and lower ends thereof in FIG. 5, respectively, have an attachment which is directed behind the plane of the drawing of FIG. 6, the winged or link pin 3.5.2' being fixed to the attachment. The sliding joint part.3.5.2" likewise fixed to the second slide part 3.2 by screw connections here and forming the slotted guide 3.5.2'" extends between the aforementioned extensions of the holder 3.5.2"" and is in contact with the latter. The upper one of the aforementioned attachments is therefore supported on an upper boundary surface 3.5.2""' of the sliding joint part 3.5.2". To this extent, the sliding joint part 3.5.2" fixed to the second slide part 3.2 forms a rest for the transverse connector 3.5 and, via the connection between the latter and the first slide part 3.1, produced by the rotary joint 3.5.1, therefore forms a support for this slide part 3.1.

As can further be gathered from FIG. 5, the rotary joint 3.5.1 connecting the transverse connector 3.5 to the first slide part 3.1, and the sliding joint 3.5.2 connecting the transverse connector 3.5 to the second slide part 3.2 are disposed at mutually corresponding ends, to be specific, with respect to the discharge direction, at the downstream ends of the two skids 3.1.1 and 3.2.1. As a result of this exposed configuration of the transverse connector 3.5, the latter is also suitable in particular for the introduction of a manual thrust force into the slide 3 and, to this extent, is also constructed in the form of a handle bar.

Figure 7:
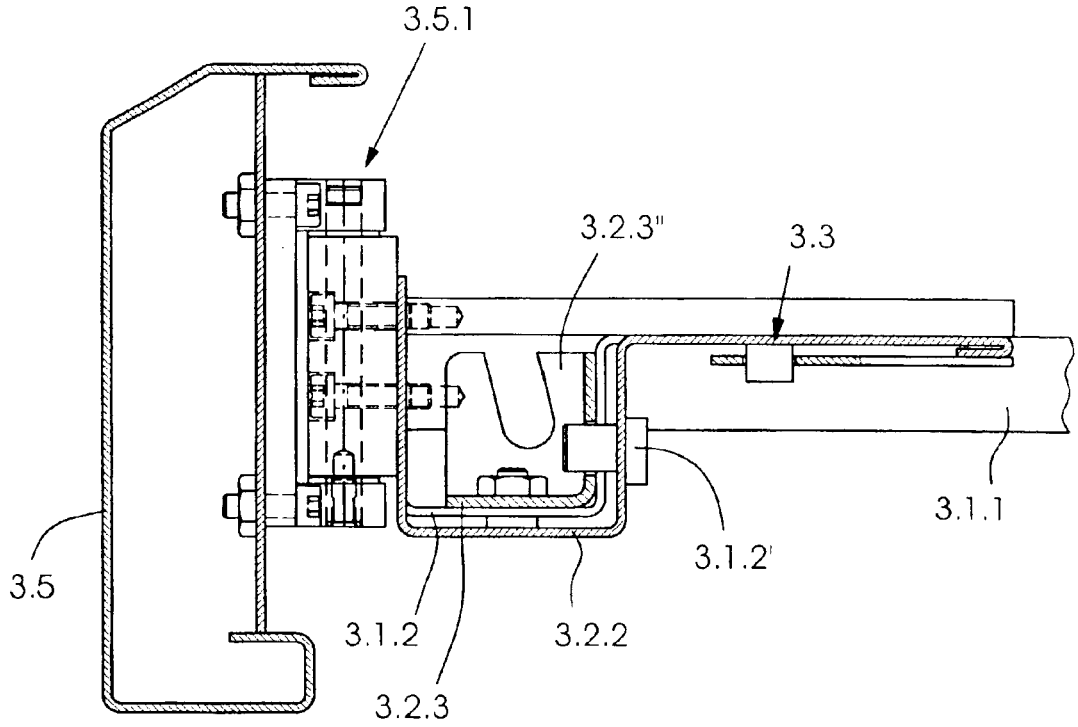
FIG. 7 is an enlarged, sectional view of FIG. 2, taken along a line VII—VII therein, in the direction of the arrows.

FIG. 7 is a cross-sectional view of an exemplary embodiment of the transverse connector 3.5 formed as a handle bar.

The displacement device described to this extent is further prepared to accommodate sheets which are discharged over a sheet pile or stack formed in the delivery during production or continuous printing in the machine for processing printing materials, a roller blind with a thin sheet web, which can be wound up and unwound, being provided for accommodating such sheets in an advantageous embodiment, the free end of the roller blind being fixed to the delivery 2 downstream with respect to the discharge direction, with regard to the aforementioned pile or stack. The winding core of the roller blind is disposed on the displacement device which, for this purpose, is formed, by way of example, as can be seen in FIG. 7. According to this construction, the profiled strip 3.2.3 is provided with a respective web 3.2.3" at end sections thereof, and a recess 3.2.3'" is formed in the respective web 3.2.3", the winding core of the roller blind being hookable into the recess 3.2.3'".

The thin sheet web which is therefore unwound when the displacement device is pulled out of the delivery 2, in this regard, runs above the drag arms 3.1.2 and 3.2.2 and, when the displacement device is pulled out, the web provides a deposit surface for discharged sheets.

We claim:

1. A machine for processing flat printing materials, comprising:

a processing station; and a delivery following said processing station in a processing direction, said delivery having a displacement device for accommodating discharged or singled-out flat printing materials, said displacement device including:

a slide displaceable along a displacement path in and counter to a thrust direction, said slide being divided by an axis extending along said thrust direction into a left hand slide part and a right hand elide part disposed beside each other; and a drag joint forming a mutual connection between said left hand slide part and said right hand slide part, said drag joint having a joint axis extending perpendicularly to said displacement path.

2. The machine according to claim 1, wherein said slide includes a pair of skids, and said drag joint is disposed at least approximately centrally between said skids.

3. The machine according to claim 1, wherein said slide includes a pair of skids and a pair of drag arms, each of said drag arms being fixed to a respective one of said skids and directed towards the respective other of said skids, and said drag joint interconnects said drag arms.

4. The machine according to claim 1, wherein a respective one of said slide parts has a support whereon said respective other of said slide parts is supported.

5. The machine according to claim 1, further comprising:

a transverse connector;

a rotary joint connecting said transverse connector to a first one of said slide parts, said rotary joint having a joint axis extending perpendicularly to said displacement path;

a sliding joint connecting said transverse connector to a second one of said slide parts and having a winged pin held on said transverse connector and disposed parallel to said joint axis; and a sliding joint part connected to said second slide part and being formed as a support for said transverse connector, said sliding joint part being formed with a slotted guide for accommodating said winged pin therein, said slotted guide extending transversely to said thrust direction.

6. The machine according to claim 3, wherein said two slides parts include a first slide part and a second slide part, said first slide part has a first skid and a first drag arm fixed to said first skid, said second slide part has a second skid and a second drag arm fixed to said second skid, a support is provided for said second drag arm of said second slide part, said support being formed on said first drag arm of said first slide part at a side of said first skid of said first slide part.

7. The machine according to claim 5, wherein said rotary joint is disposed at one end of one of said skids, said sliding joint is disposed at a corresponding end of said other of said skids, and said transverse connector is formed as a handle bar.

8. A sheet-processing rotary printing press, comprising:

a processing station; and a deliver following said processing station in a processing direction, said delivery including a displacement device, said displacement device including:

a slide displaceable along a displacement path in and counter to a thrust direction, said slide being divided by an axis extending along said thrust direction into a left hand slide part and a right hand slide part disposed beside each other; and a drag joint forming a mutual connection between said left hand slide part and said right hand slide part, said drag joint having a joint axis extending perpendicularly to said displacement path.

* * * * *